US006116123A

United States Patent [19]

Chen

[11] Patent Number: 6,116,123

[45] Date of Patent: Sep. 12, 2000

[54] SCREW DRIVER HAVING A RETRACTABLE AND ROTATABLE HANDLE

[76] Inventor: Chun Chiung Chen, P.O. Box 63-99, Taichung, Taiwan

[21] Appl. No.: 09/086,698

[22] Filed: May 27, 1998

[51] Int. Cl.[7] ..... B25B 23/16

[52] U.S. Cl. ..... 81/177.2; 81/177.5; 81/177.6; 81/58.1

[58] Field of Search ..... 81/177.2, 177.5, 81/177.6, 177.7, 58.1, 73

[56] References Cited

U.S. PATENT DOCUMENTS

| | | | |
|---|---|---|---|
| 652,414 | 6/1900 | Wilson | 81/177.6 |
| 1,120,334 | 12/1914 | Prokop | 81/177.6 |
| 2,182,673 | 12/1939 | Magnano | 81/177.7 |
| 2,572,444 | 10/1951 | Carden | 81/177.2 |
| 3,068,728 | 12/1962 | Shepherd | 81/177.7 |
| 5,722,307 | 3/1998 | Chen | 81/177.2 |

*Primary Examiner*—David A. Scherbel
*Assistant Examiner*—Joni B. Danganan

[57] ABSTRACT

A screw driver includes a hand grip having a driving stem extended forward from the hand grip, and a slide slidably engaged in the hand grip and rotated in concert with the hand grip. A handle is pivotally coupled to the slide at a pivot shaft for allowing the handle to be rotated relative to the slide and the hand grip to a perpendicular position relative to the hand grip and for allowing the hand grip and the driving stem to be rotated by the handle via the slide. The handle may include a retractable pole slidably engaged in a tube which is pivotally coupled to the slide.

6 Claims, 4 Drawing Sheets

SCREW DRIVER HAVING A RETRACTABLE AND ROTATABLE HANDLE

BACKGROUND OF THE INVENTION

1. Field of the Invention

The present invention relates to a screw driver, and more particularly to a screw driver having a retractable and rotatable handle.

2. Description of the Prior Art

The closest prior art of which the applicant is aware is her prior U.S. Pat. No. 5,722,307 to CHEN and comprises a retractable handle coupled to the driving stem, such that the driving stem should be retracted or extended outward of the screw driver body and such that the screw driver should be made with a great size for slidably receiving the retractable driving stem. In addition, the driving stem is coupled to and directly driven by the retractable handle which may not apply a great torque to the driving stem.

The present invention has arisen to mitigate and/or obviate the afore-described disadvantages of the conventional screw drivers.

SUMMARY OF THE INVENTION

The primary objective of the present invention is to provide a screw driver having a retractable and rotatable handle that may apply a great torque to the driving stem.

In accordance with one aspect of the invention, there is provided a screw driver comprising a hand grip including a non-circular bore formed therein and including a first end having a driving stem extended forward therefrom and including a second end, a slide slidably engaged in the non-circular bore of the hand grip and including a non-circular cross section corresponding to that of the bore of the hand grip for allowing the slide to be slid along the bore and to be rotated in concert with the hand grip, a handle pivotally coupled to the slide at a pivot shaft for allowing the handle to be rotated relative to the slide and the hand grip about the pivot shaft to a perpendicular position relative to the hand grip and for allowing the hand grip and the driving stem to be rotated by the handle via the slide and for allowing the driving stem to be directly driven and rotated by the hand grip.

The handle includes a tube, and a pole slidably engaged in the tube and extendible outward of the tube and having a first end pivotally coupled to the slide at the pivot shaft and having a second end, and means for limiting a relative movement between the tube and the pole. The second end of the pole includes an enlarged head, the tube includes a first end having an annular flange extended radially inward for engaging with the enlarged head of the pole and for preventing the pole from being disengaged from the tube. The handle includes a knob pivotally coupled to the tube at a pivot pin for allowing the knob to be rotated to a perpendicular position relative to the handle.

A confining means is further provided for confining the slide in the bore of the hand grip. The confining means includes a cap secured to the second end of the hand grip, the cap includes an orifice for slidably receiving the handle and for allowing the handle to be extended outward of the hand grip.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
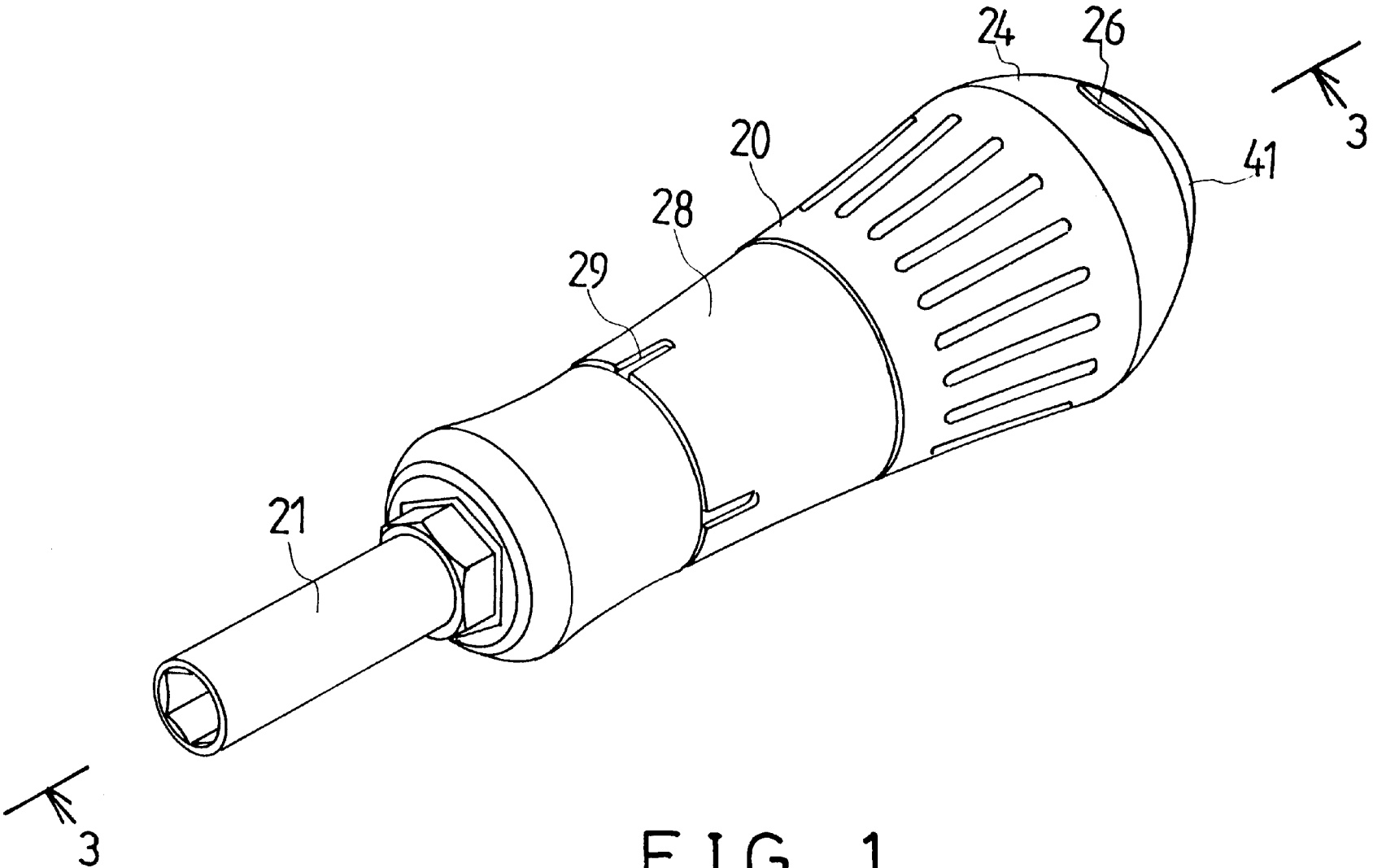
FIG. 1 is a perspective view of a screw driver in accordance with the present invention.
Figure 2:
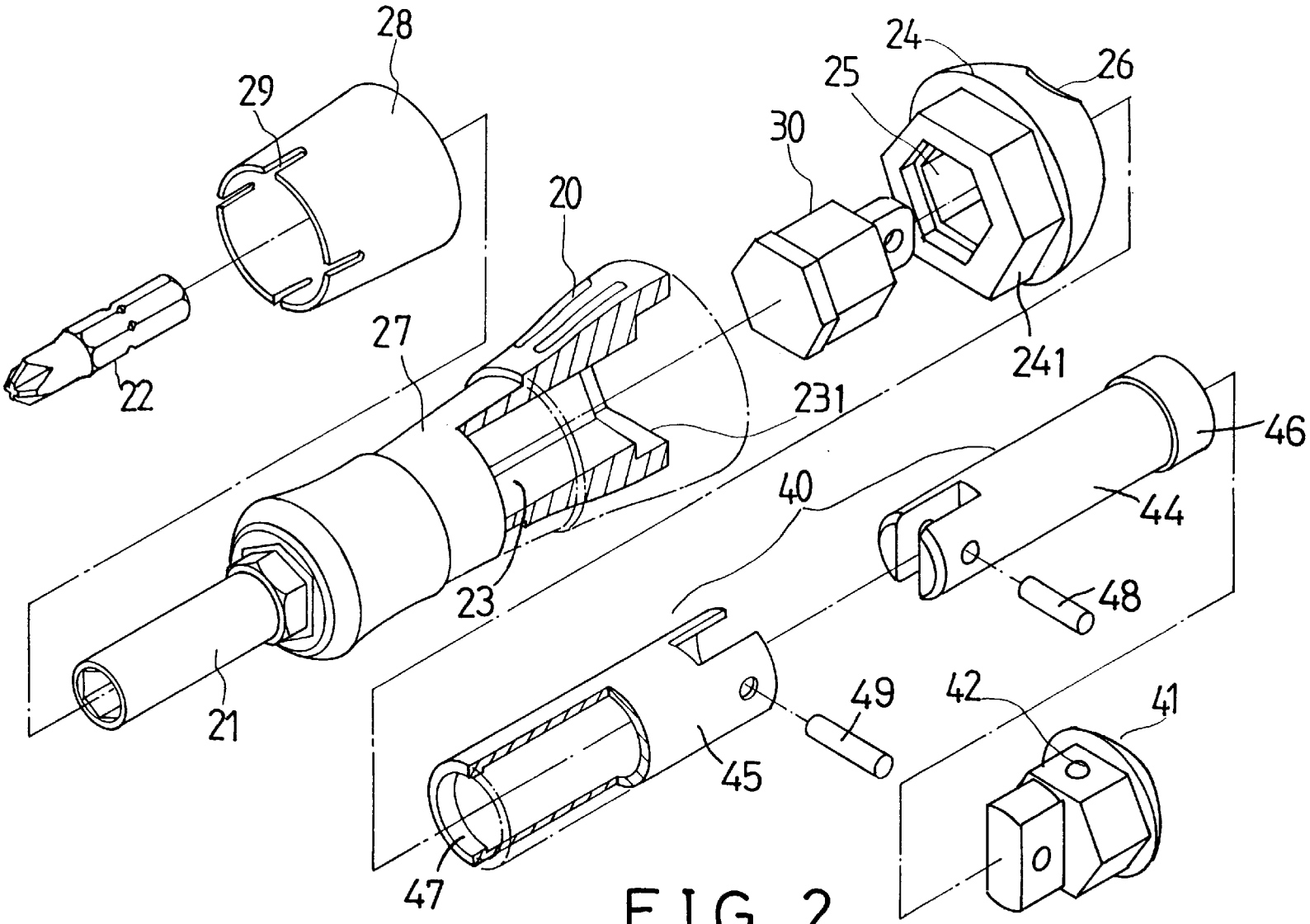
FIG. 2 is an exploded view of the screw driver.
Figure 3:
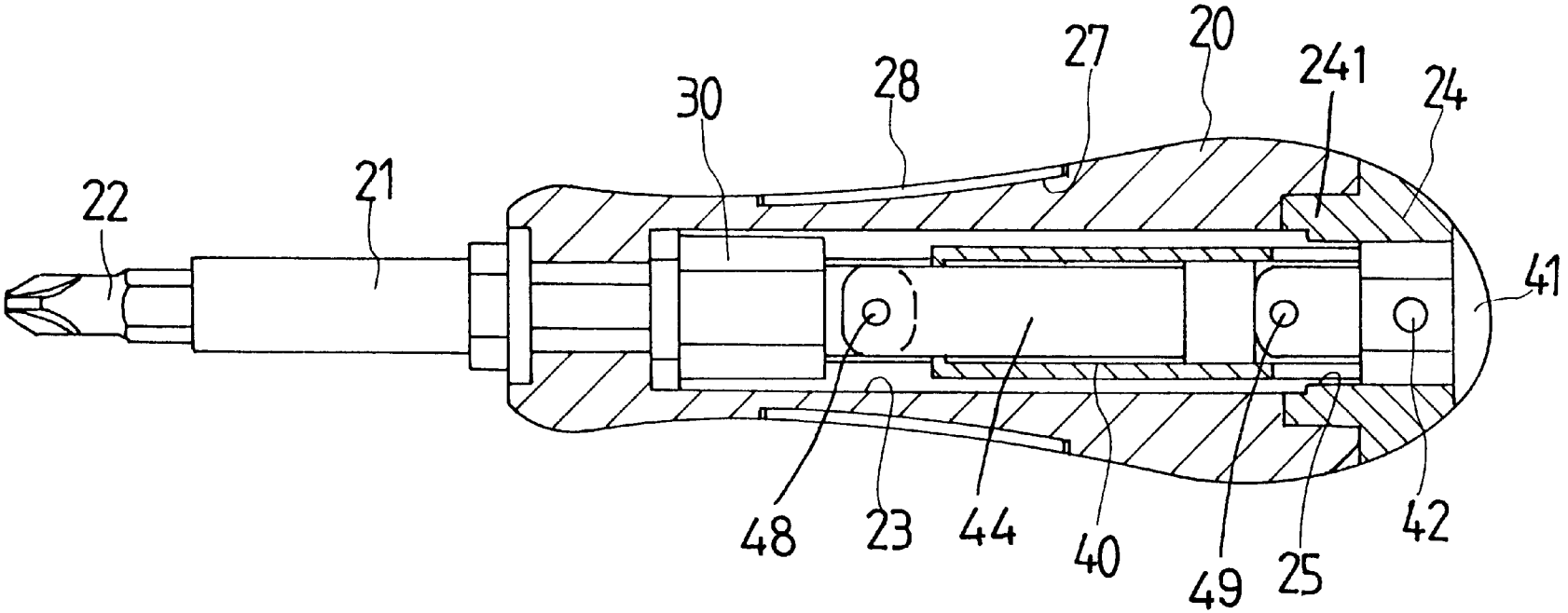
FIG. 3 is a cross sectional view taken along lines 3—3 of FIG. 1.

Referring to the drawings, and initially to FIGS. 1–3, a screw driver in accordance with the present invention comprises a hand grip 20 including a driving stem 21 extended forward therefrom for engaging with a tool bit 22 or a fastener and including a non-circular bore 23 for slidably receiving a slide 30 that includes a non-circular cross section, such that the slide 30 may be slid along the bore 23 and may be rotated in concert with the hand grip 20. The hand grip 20 includes an opening 231 formed in the rear portion, and includes an annular recess 27 formed in the middle portion for rotatably receiving a ferrule 28 which includes a number of slits 29 for forming a resilient characteristic to the ferrule 28 and for allowing the ferrule 28 to be easily engaged onto the hand grip 20.

Figure 4:
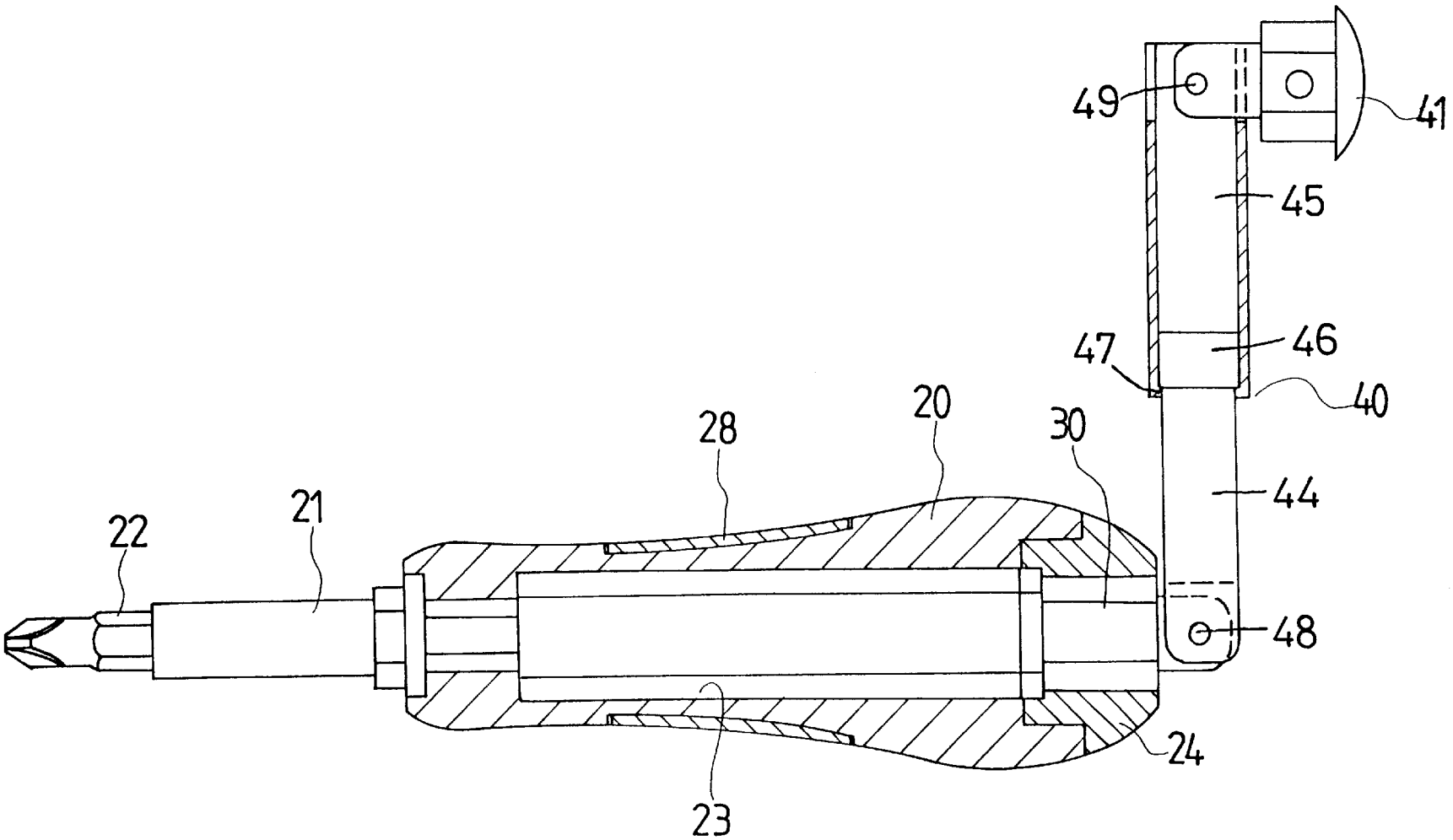
FIG. 4 is a cross sectional view similar to FIG. 3, illustrating the operation of the screw driver.

A cap 24 includes a bulge 241 engaged in the opening 231 of the hand grip 20 and secured to the hand grip 20 by such as welding process or by adhesive materials or by force-fitted engagement. The cap 24 includes an orifice 25 formed in the center and communicating with the bore 23 of the hand grip 20 and includes a depression 26 formed in the outer portion and communicating with the orifice 25. The cap 24 is provided for engaging with the slide 30 and for preventing the slide 30 from being disengaged from the hand grip 20. A handle 40 includes a pole 44 slidably engaged in a tube 45 and having an enlarged head 46 formed on the rear end for engaging with an annular flange 47 that is extended radially inward from the front end of the tube 45 and for limiting the relative movement between the tube 45 and the pole 44 and for allowing the pole 44 to be extended outward (FIG. 4) or retracted into the tube 45 (FIG. 3). The pole 44 has a front end pivotally coupled to the slide 30 at a pivot shaft 48 for allowing the pole 44 to be rotated to a position perpendicular to the hand grip 20 and for allowing the hand grip 20 and the driving stem 21 to be rotated by the pole 44 and/or the tube 45. A knob 41 is pivotally coupled to the rear end of the tube 45 at a pivot pin 49 for allowing the knob 41 to be rotated relative to the tube 45 to a position perpendicular to the tube 45 and the pole 44 (FIG. 4) and for allowing the hand grip 20 to be easily rotated by the pole 44 and the tube 45 via the knob 41. The knob 41 includes a spring biased projection 42 for engaging with the cap 24 and for securing the knob 41 to the cap 24 and the hand grip 20. The depression 26 is provided for allowing the knob 41 to be easily moved outward of the cap 24 by the user.

It is to be noted that the driving stem 21 is solidly engaged with or secured to the hand grip 20 and may not be retracted inward of the hand grip 20 and is not coupled to the slide 30, such that the driving stem 21 is driven and rotated by the hand grip 20. The hand grip 20 includes a stronger structure than that of the tube 45 and the pole 44 such that the hand grip 20 may apply a greater torque to the driving stem 21 than that of the tube 45. The pole 44 and/or the tube 45 may apply a great torque to the hand grip 20 via the slide 30. The user may hold the ferrule 28 while the hand grip 20 is rotated by the pole 44 and/or the tube 45.

Accordingly, the screw driver in accordance with the present invention includes a retractable and rotatable handle that may apply a great torque to the driving stem.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A screw driver comprising:

a hand grip including a non-circular bore formed therein and including a first end having a driving stem extended forward therefrom and including a second end, a slide slidably engaged in said non-circular bore of said hand grip and including a non-circular cross section corresponding to that of said bore of said hand grip for allowing said slide to be slid along said bore and to be rotated in concert with said hand grip, a handle pivotally coupled to said slide at a pivot shaft for allowing said handle to be rotated relative to said slide and said hand grip about said pivot shaft to a perpendicular position relative to said hand grip and for allowing said hand grip and said driving stem to be rotated by said handle via said slide.

2. The screw driver according to claim 1, wherein said handle includes a tube, and a pole slidably engaged in said tube and extendible outward of said tube and having a first end pivotally coupled to said slide at said pivot shaft and having a second end, and means for limiting a relative movement between said tube and said pole.

3. The screw driver according to claim 2, wherein said limiting means includes an enlarged head formed on said second end of said pole and includes an annular flange formed on a first end of said tube and extended radially inward of said tube for engaging with said enlarged head of said pole and for limiting the relative movement between said tube and said pole and for preventing said pole from being disengaged from said tube.

4. The screw driver according to claim 2, wherein said handle includes a knob pivotally coupled to said tube at a pivot pin for allowing said knob to be rotated to a perpendicular position relative to said handle.

5. The screw driver according to claim 1 further comprising means for confining said slide in said bore of said hand grip.

6. The screw driver according to claim 5, wherein said confining means includes a cap secured to said second end of said hand grip, said cap includes an orifice for slidably receiving said handle and for allowing said handle to be extended outward of said hand grip.

* * * * *